US008494208B2

(12) United States Patent
Fordham

(10) Patent No.: US 8,494,208 B2
(45) Date of Patent: Jul. 23, 2013

(54) INERTIAL VIBRATION EXCITER

(75) Inventor: Julian Fordham, Hong Kong (CN)

(73) Assignee: New Transducers Limited, Cambourne, Cambridgeshire (GB)

( * ) Notice: Subject to any disclaimer, the term of this patent is extended or adjusted under 35 U.S.C. 154(b) by 91 days.

(21) Appl. No.: 13/054,233

(22) PCT Filed: Jul. 17, 2008

(86) PCT No.: PCT/GB2008/050589
§ 371 (c)(1),
(2), (4) Date: Apr. 21, 2011

(87) PCT Pub. No.: WO2010/007335
PCT Pub. Date: Jan. 21, 2010

(65) Prior Publication Data
US 2011/0206230 A1 Aug. 25, 2011

(51) Int. Cl.
*H04R 1/02* (2006.01)
*H04R 9/06* (2006.01)
*H04R 11/02* (2006.01)

(52) U.S. Cl.
USPC ..... 381/396; 381/152; 381/412

(58) Field of Classification Search
USPC ..... 381/150, 151, 152, 396, 400, 412, 381/397
See application file for complete search history.

(56) References Cited

U.S. PATENT DOCUMENTS

| | | | |
|---|---|---|---|
| 3,636,281 | A | 1/1972 | Cozart |
| 4,506,117 | A | 3/1985 | Fresard |
| 5,125,031 | A | 6/1992 | Ledonne |
| 6,192,136 | B1 | 2/2001 | Azima et al. |
| 2002/0034314 | A1 | 3/2002 | Colloms et al. |

FOREIGN PATENT DOCUMENTS

| | | |
|---|---|---|
| EP | 1322137 | 6/2003 |
| WO | 97/09842 | 3/1997 |
| WO | 00/22877 | 4/2000 |

*Primary Examiner* — Tuan D Nguyen
(74) *Attorney, Agent, or Firm* — Alan I. Cantor; Roylance, Abrams, Berdo & Goodman, L.L.P.

(57) ABSTRACT

An inertial vibration exciter having a magnet assembly defining an annular gap, a coil assembly disposed in the annular gap, suspension means mounting the coil assembly for reciprocating movement in the gap, means coupling the coil assembly to a member to be vibrated, and a hermetically sealed housing in which the magnet assembly, the coil assembly, the suspension means and the coupling means are disposed. The housing may comprise a heat sink thermally coupled to the magnet assembly and the heat sink may be resiliently coupled to the housing. The coupling means may comprise a plate-like member to which the coil is rigidly attached and of a size substantially greater than the diameter of the coil. The plate-like member may be resiliently coupled to the housing. Mounting means such as a pressure-sensitive adhesive member may be positioned centrally on the plate-like coupling means and adapted to mount the inertial vibration exciter to the member to be vibrated, the mounting means being of a substantially smaller size than the coupling means to leave the periphery of the coupling means free to move.

9 Claims, 1 Drawing Sheet

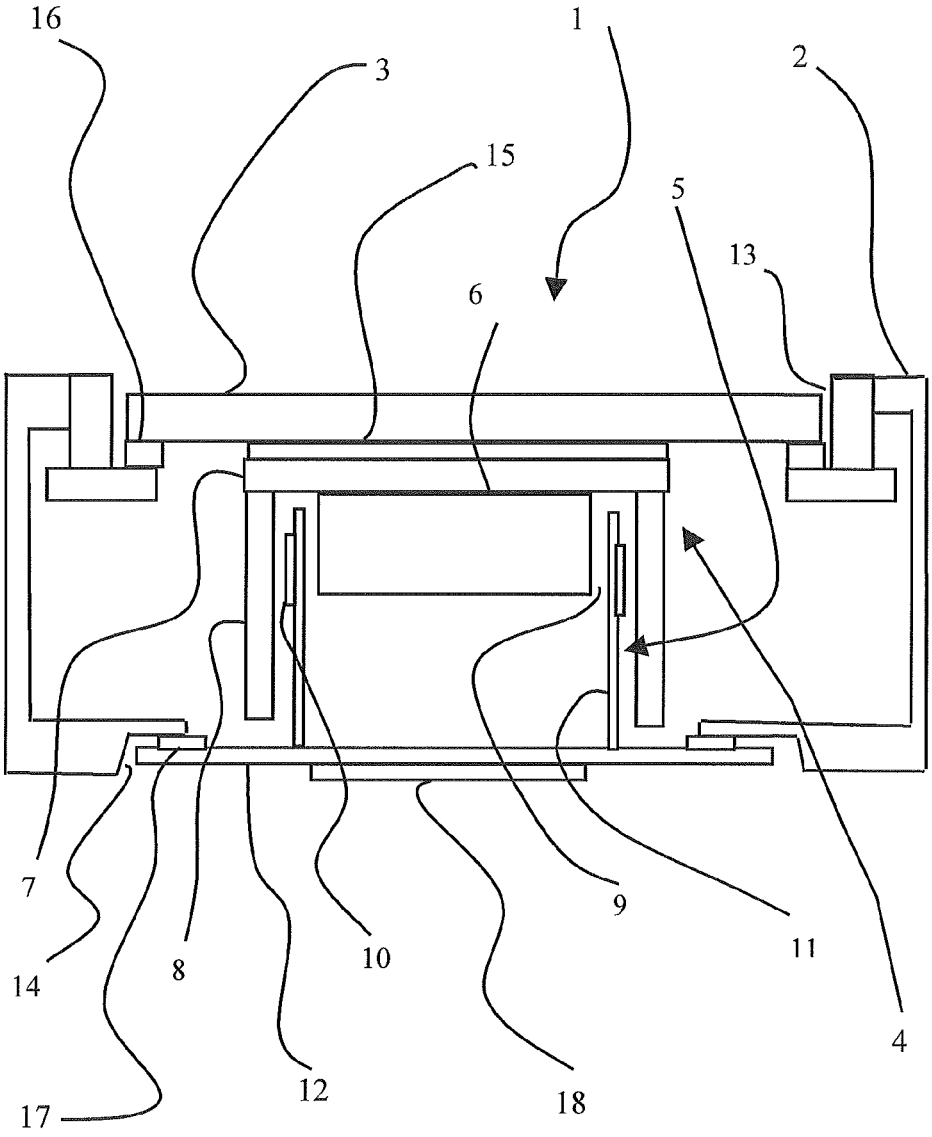
16
3
1
2
15
5
13
6
7
14
17
8
12
10
18
9
11
4

INERTIAL VIBRATION EXCITER

TECHNICAL FIELD

The invention relates to inertial vibration exciters or shakers, for example of the kind generally described in International Patent Specification WO97/09842. Such exciters can be used to vibrate members, which are often plate-like, to cause them to radiate acoustically to form a loudspeaker.

BACKGROUND ART

It is known to provide vibration exciters or shakers for exciting arbitrary objects such as the wall of a building or domestic or office furniture, see, for example U.S. Pat. No. 4,506,117 of Fresard. Often, such devices comprise a magnet assembly defining an annular gap, a coil assembly disposed in the annular gap, suspension means mounting the coil assembly for reciprocating movement in the annular gap, the device being arranged to be mounted to the surface of a member to be vibrated, for example a suspended ceiling tile, in the case of Fresard.

DISCLOSURE OF INVENTION

It is an object of the invention to provide a robust vibration exciter which may be used in outside environments or where water may be present.

According to the invention there is provided an inertial vibration exciter having a magnet assembly defining an annular gap, a coil assembly disposed in the annular gap, suspension means mounting the coil assembly for reciprocating movement in the gap, and means coupling the coil assembly to a member to be vibrated, characterised by a hermetically sealed housing in which the magnet assembly, the coil assembly, the suspension means and the coupling means is disposed.

The housing may comprise a heat sink thermally coupled to the magnet assembly. The heat sink may be resiliently coupled to the housing.

The coupling means may comprise a plate-like member to which the coil is rigidly attached and of a size substantially greater than the diameter of the coil. The plate-like coupler member may be resiliently coupled to the housing. The plate-like member may be substantially circular and the resilient coupling may be by way of an annular resilient member. The plate-like coupler may be capable of flexure and may be mounted to permit the flexure to form part of the suspension means.

The inertial vibration exciter may comprise means positioned centrally on the plate-like coupling means and adapted to mount the inertial vibration exciter to the member to be vibrated, the mounting means being of a substantially smaller size than the coupling means to leave the periphery of the coupling means free to move. The mounting means may comprise a pressure sensitive adhesive member.

BRIEF DESCRIPTION OF DRAWING

The invention is diagrammatically illustrated, by way of example, in the accompanying drawing which is a sectional side view of an inertial vibration exciter or shaker according to the invention.

BEST MODE FOR CARRYING OUT THE INVENTION

In the drawing there is shown an inertial vibration exciter (1) adapted for coupling to a member (not shown) to be vibrated to radiate an acoustic output and thus to form a loudspeaker. This member may be any suitable object such as the wall or other surface of a building, or furniture or a fitting or installation in a building. The member is preferably panel-form, e.g. a door or desk top or may be the side of a bath or shower cubicle or the like.

The exciter (1) comprises a hermetically sealed housing (2) which may be moulded from a plastics material, e.g. that known as ABS. The housing is in the form of a squat cylinder having openings (13, 14) in its opposed axial ends. The exciter housing (2) contains a magnet assembly (4) comprising a circular magnet (6), a disc-like pole piece (7) and a tubular extension (8) which encloses the magnet (6) to form an annular gap (9) there-between. The pole piece (7) is firmly fixed to a disc-like heat radiator or sink (3), which may be of aluminium or the like. The pole piece (7) and the heat sink (3) are bonded together by a thin film of heat-conductive pressure-sensitive adhesive material (15). The heat sink (3) closes the open axial end (13) of the housing by way of a resilient annular seal (16).

The housing (2) also contains a coil assembly (5) which comprises a tubular coil former (11) on which is wound a coil (10). One end of the coil former (11) is rigidly fixed to a thin plate-like coupler (12), which may be in the form of a disc and made of a plastics material. The coupler closes the other open axial end (14) of the housing (2) by way of a resilient annular seal (17) positioned at the marginal edge of the coupler. In this way the housing is hermetically sealed and both the magnet assembly (4) and the coil assembly (5) are resiliently suspended in the housing (2). It is to be noted that the diameter of the coupler is substantially greater than that of the coil and coil former and that the arrangement is such that a portion of the coupler outside the diameter of the coil former and inside the coupler's connection at its marginal edge to the housing is capable of flexing to form part of the suspension of the coil assembly relative to the magnet assembly.

It will be appreciated that the arrangement is such that the coil (10) is positioned in the annular gap (9) so that the coil assembly can reciprocate in an axial direction relatively to the magnet assembly when the coil is energised with an electrical signal in the usual manner to apply force to the member to be vibrated to produce an acoustic output.

A mounting member in the form of a disc (18) of a pressure-sensitive material is fixed centrally to the outer face of the coupler (12) and provides means whereby the exciter (1) can be mounted to the member to be vibrated. The disc (18) is of a diameter substantially smaller than that of the coupler so that the portion of the coupler between the coil assembly and its mounting on the housing via the seal (17) is free to flex when the exciter is mounted to the surface to be vibrated. It has been found that this substantially improves the performance of the exciter in use. If desired, a resilient annular seal (not shown) may be positioned at the edge of the coupler to seal between the coupler and the member to be vibrated to prevent ingress of foreign material into the marginal gap between the coupler and the member.

INDUSTRIAL APPLICABILITY

The vibration exciter described with reference to the accompanying drawing is rugged and is hermetically sealed so that it is capable of operating in adverse environments but can nevertheless be made inexpensively and to be of relatively light-weight whereby it is possible to fix the exciter in position using a pressure-sensitive adhesive.

The invention claimed is:

1. An inertial vibration exciter comprising a magnet assembly defining an annular gap, a coil assembly disposed in the annular gap, a suspension mounting the coil assembly for reciprocating movement in the gap, a coupler adapted to couple the coil assembly to a member to be vibrated, and a hermetically sealed housing in which the magnet assembly, the coil assembly, the suspension and the coupler are disposed, wherein the magnet assembly is resiliently suspended in the housing.

2. An inertial vibration exciter according to claim 1, wherein the housing comprises a heat sink thermally coupled to the magnet assembly.

3. An inertial vibration exciter according to claim 2, wherein the heat sink is coupled to the housing via a resilient seal.

4. An inertial vibration exciter according to claim 1, wherein the coupler comprises a plate-like member to which the coil is rigidly attached and of a size substantially greater than the diameter of the coil.

5. An inertial vibration exciter according to claim 4, wherein the plate-like member is coupled to the housing via a resilient seal.

6. An inertial vibration exciter according to claim 5, wherein the plate-like member is substantially circular and the resilient seal comprises an annular member.

7. An inertial vibration exciter according to claim 6, wherein the plate-like member is mounted to the housing at its marginal edge to leave an intermediate portion between its marginal edge and the coil assembly capable of flexure to form part of the suspension.

8. An inertial vibration exciter according to claim 7, wherein the coupler comprises a mounting member positioned centrally on the plate-like member and adapted to mount the inertial vibration exciter to the member to be vibrated, the mounting member being of a substantially smaller size than the plate-like member to leave a portion of the plate-like member free to flex.

9. An inertial vibration exciter according to claim 8, wherein the mounting member comprises a pressure-sensitive adhesive member.

* * * * *